US009050510B2

(12) United States Patent
Ines et al.

(10) Patent No.: US 9,050,510 B2
(45) **Date of Patent: *Jun. 9, 2015**

(54) PUTTER HEAD

(71) Applicant: Taylor Made Golf Company, Inc., Carlsbad, CA (US)

(72) Inventors: Marni D. Ines, San Marcos, CA (US); Bret H. Wahl, Escondido, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/076,796

(22) Filed: Nov. 11, 2013

(65) Prior Publication Data

US 2014/0066226 A1 Mar. 6, 2014

Related U.S. Application Data

(63) Continuation of application No. 13/736,787, filed on Jan. 8, 2013, now Pat. No. 8,579,718, which is a continuation of application No. 13/545,938, filed on Jul. 10, 2012, now Pat. No. 8,348,781, which is a continuation of application No. 13/301,659, filed on Nov. 21, 2011, now Pat. No. 8,216,082, which is a continuation of application No. 12/151,782, filed on May 8, 2008, now Pat. No. 8,066,581.

(51) Int. Cl.
*A63B 69/36* (2006.01)
*A63B 53/04* (2006.01)

(52) U.S. Cl.
CPC ..... *A63B 53/0487* (2013.01); *A63B 2053/0408* (2013.01); *A63B 2053/0433* (2013.01); *A63B 2053/0437* (2013.01); *A63B 2053/0441* (2013.01)

(58) Field of Classification Search
USPC ..... 473/324–350, 287–292, 251–256, 313; D21/736–746
See application file for complete search history.

(56) References Cited

U.S. PATENT DOCUMENTS 3,143,349 A 8/1964 Macintyre
3,516,674 A 6/1970 Scarborough (Continued)

OTHER PUBLICATIONS

Final Office action in U.S. Appl. No. 12/151,782, dated Apr. 8, 2011.

(Continued)

*Primary Examiner* — Sebastiano Passaniti
(74) *Attorney, Agent, or Firm* — Klarquist Sparkman, LLP

(57) ABSTRACT

Embodiments of a putter-type golf club head with an increased moment of inertia about the X axis ($MOI_{xx}$) and an increased moment of inertia about the Z axis ($MOI_{zz}$) are disclosed. Generally, the $MOI_{zz}$ is increased by designing the putter such that the center of gravity (CG) of the putter head is located at or behind the geometric center of the putter head. Additionally, the mass of the putter head is concentrated at the outer edges of the putter head. To accomplish this, the ratio of the width of the front of the putter head to the width of the rear of the putter head is no greater than 0.55:1. The $MOI_{xx}$ is further increased by locating the CG relatively close to the bottom of the putter head.

11 Claims, 4 Drawing Sheets

(56) References Cited

U.S. PATENT DOCUMENTS

| | | | |
|---|---|---|---|
| D234,962 | S | 4/1975 | Swash |
| 4,010,958 | A | 3/1977 | Long |
| 4,754,976 | A | 7/1988 | Pelz |
| 5,058,895 | A | 10/1991 | Igarashi |
| 5,131,656 | A | 7/1992 | Kinoshita |
| 5,482,281 | A | 1/1996 | Anderson |
| 5,685,784 | A | 11/1997 | Butler |
| 5,769,736 | A | 6/1998 | Sato |
| 5,976,025 | A | 11/1999 | Williams |
| 5,993,330 | A | 11/1999 | Akerstrom |
| 6,086,484 | A | 7/2000 | Uebelhor |
| 6,607,452 | B2 | 8/2003 | Helmstetter et al. |
| 6,716,110 | B1 | 4/2004 | Ballow |
| 6,716,114 | B2 | 4/2004 | Nishio |
| D496,417 | S | 9/2004 | Tang |
| 6,896,625 | B2 | 5/2005 | Grace |
| 6,932,716 | B2 | 8/2005 | Ehlers et al. |
| 6,984,181 | B2 | 1/2006 | Hettinger et al. |
| 6,988,959 | B2 | 1/2006 | Pollman |
| 7,004,849 | B2 | 2/2006 | Cameron |
| 7,018,304 | B2 | 3/2006 | Bradford |
| D520,584 | S | 5/2006 | Karlsen |
| D541,362 | S | 4/2007 | Oldknow |
| 7,201,668 | B1 | 4/2007 | Pamias |
| D542,872 | S | 5/2007 | Oldknow |
| 7,244,191 | B2 | 7/2007 | Tang et al. |
| D569,460 | S | 5/2008 | Walker et al. |
| 7,407,443 | B2 | 8/2008 | Franklin et al. |
| 7,438,648 | B2 | 10/2008 | Wahl et al. |
| D584,780 | S | 1/2009 | Ines et al. |
| 7,491,131 | B2 | 2/2009 | Vinton |
| 7,594,865 | B2 | 9/2009 | Ines |
| 7,648,425 | B2 | 1/2010 | Wahl et al. |
| 7,682,263 | B2 | 3/2010 | Yamamoto |
| 8,066,581 | B2 | 11/2011 | Ines et al. |
| 8,216,082 | B2 | 7/2012 | Ines et al. |
| 8,348,781 | B2 | 1/2013 | Ines et al. |
| 8,579,718 | B2 | 11/2013 | Ines et al. |
| 2002/0025855 | A1 | 2/2002 | Sosin |
| 2004/0138003 | A1 | 7/2004 | Grace |
| 2004/0173964 | A1 | 9/2004 | Pollman |
| 2006/0148587 | A1 | 7/2006 | Stevens et al. |
| 2007/0191135 | A1 | 8/2007 | Nilsson et al. |
| 2013/0123042 | A1 | 5/2013 | Ines et al. |

OTHER PUBLICATIONS

Office action in U.S. Appl. No. 12/151,782, dated May 13, 2010.
Office action in U.S. Appl. No. 12/151,782, dated Nov. 29, 2010.
Office action in U.S. Appl. No. 13/301,659, dated Feb. 10, 2012.
Office action in U.S. Appl. No. 13/545,938, dated Aug. 9, 2012.
Office action in U.S. Appl. No. 13/736,787, dated Mar. 14, 2013.
Restriction Requirement in U.S. Appl. No. 12/151,782, dated Jan. 4, 2010.

PUTTER HEAD

CROSS REFERENCE TO RELATED APPLICATION

The present application is a continuation of U.S. Pat. No. 13/736,787, filed Jan. 8, 2013, which is a continuation of U.S. patent application Ser. No. 13/545,938, filed Jul. 10, 2012, now U.S. Pat. No. 8,348,781, which is a continuation of U.S. patent application Ser. No. 13/301,659, filed Nov. 21, 2011, now U.S. Pat. No. 8,216,082, which is a continuation of U.S. patent application Ser. No. 12/151,782, filed May 8, 2008, now U.S. Pat. No. 8,066,581, which are incorporated herein by reference.

FIELD

This invention relates to the field of golf club heads and more particularly, but not exclusively, to putter-type golf club heads.

BACKGROUND

A force is exerted on both a golf club and a golf ball when the club hits the ball. If the hit is slightly off-center with respect to the typical golf club (e.g., the center of gravity of the golf club is not directly behind the point on the golf club where the club strikes the ball), then this force can cause the golf club to twist slightly. The twisting of the golf club leads to the golf ball not traveling in the direction intended by the player. Alternatively, the twisting can lead to the ball skipping over the ground rather than rolling forward in a smooth manner. Additionally, less energy is imparted to the golf ball from the putter when the putter twists. This commonly causes off-center hits to fall short of their intended target.

Golfers in general desire clubs with maximum forgiveness and true, straight, and consistent forward roll when they strike a golf ball. This is particularly true for putter-type golf clubs which are used when golfers generally need a large degree of precision and consistency for each shot. Several designs have been used or proposed to achieve this desired consistency. However, none of them have the features or advantages described below.

SUMMARY OF THE INVENTION

Described below are embodiments of a putter-type golf club head and associated methods in accordance with the invention that tend to increase the consistency of ball motion, and thus accuracy, from shot to shot.

In one embodiment of the invention, a golf club head for a putter is generally frusto-triangular and comprises a front face and a rear face, and the ratio of the width of the front face to the width of the rear face is generally less than or equal to 0.55:1.

In some embodiments of the invention, the golf club head comprises a center section that extends behind the front face and has the same width as the width of the front face. The golf club head further comprises a first outer section that is a generally wedge shaped portion of the club head that is outside of the center section and comprises no less than about 15% of the total mass of the club head. Additionally, the golf club head further comprises a second outer section that is generally wedge shaped and located on the opposite side of the center section from the first outer section, and the second outer section also comprises no less than about 15% of the total mass of the club head.

In certain embodiments the center section additionally comprises a front portion and a rear portion. In these embodiments the rear portion of the first outer section that is adjacent to the rear portion of the center section comprises at least about 11% of the total mass of the club head. Similarly, the rear portion of the second outer section that is adjacent to the rear portion of the center section also comprises at least about 11% of the total mass of the club head.

The foregoing and other objects, features, and advantages of the invention will become more apparent from the following detailed description, which proceeds with reference to the accompanying figures.

DETAILED DESCRIPTION

Figure 1:
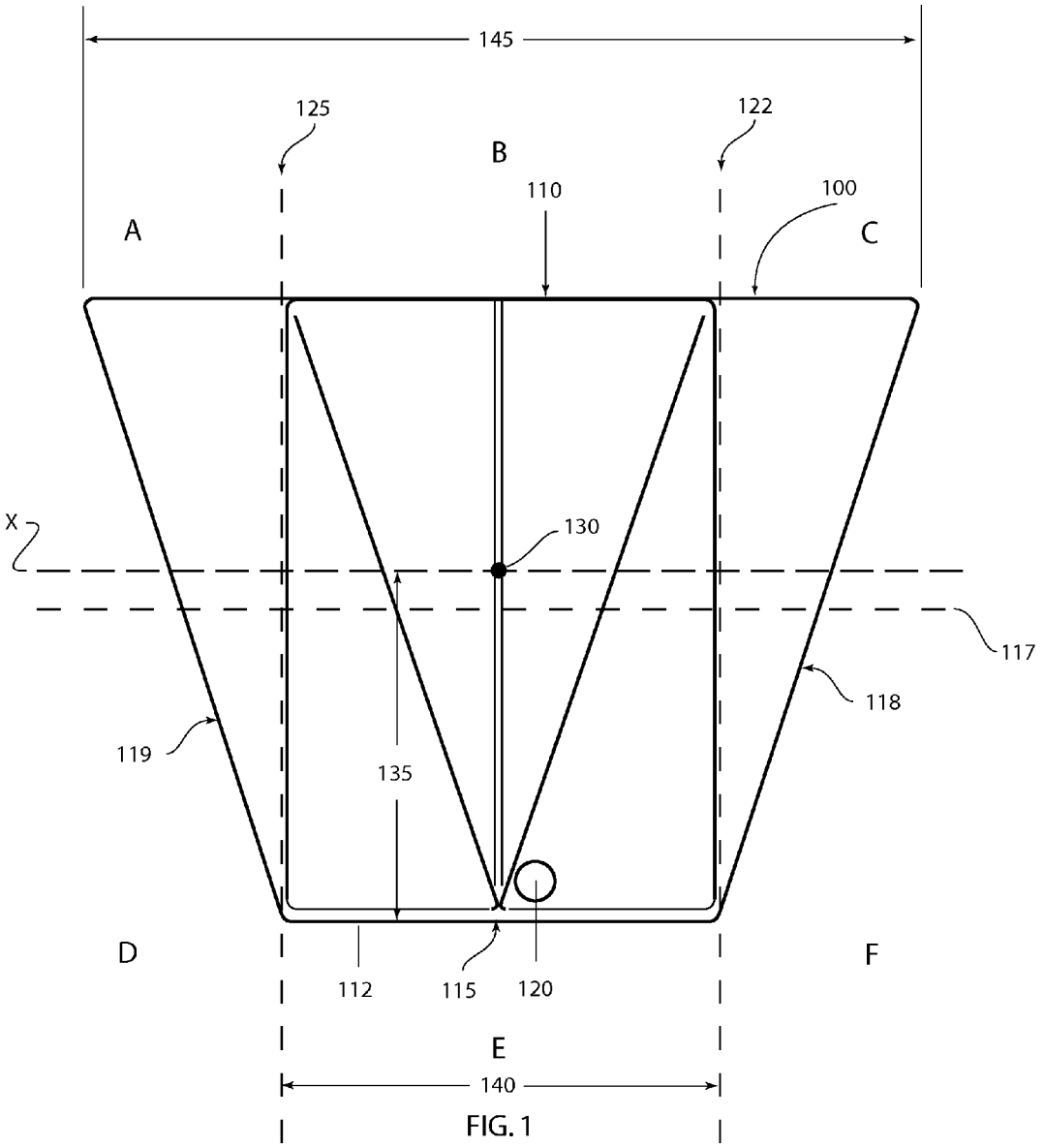
FIG. 1 illustrates a top plan view of one embodiment of a putter type golf club head according to the present invention.

The following describes embodiments of a putter type golf club head with mass concentrated at or behind the geometric center of the golf club head.

The following makes reference to the accompanying drawings which form a part hereof, wherein like numerals designate like parts throughout. The drawings illustrate specific embodiments, but other embodiments may be formed and structural changes may be made without departing from the intended scope of this disclosure and invention. Directions and references (e.g., up, down, top, bottom, left, right, rearward, forward, heelward, etc.) may be used to facilitate discussion of the drawings but are not intended to be limiting. Accordingly, the following detailed description shall not be construed in a limiting sense and the scope of property rights sought shall be defined by the appended claims and their equivalents.

Certain terms will be used to address certain sections of the golf club head. For example, the "heel" of a golf club head generally refers to the section of the golf club head that is closest to a player when the player is addressing the golf club head in a normal playing stance. The "toe" of a golf club head generally refers to the section of the golf club head that is furthest from a player when the player is addressing the golf club head in a normal playing stance. Additionally, the "front" of the golf club head generally refers to the portion of the golf club head directly adjacent to the striking face of the club head, and the "rear" of the golf club head generally refers to the portion of the club head furthest from the striking face of the club head.

General Club Design

As described above, a putter-type golf club twists when striking a golf ball at an off-center portion of the putter head. If the putter head twists around a vertical axis, this twisting causes the golf ball to travel in a direction other than the direction intended by the golf player. If the putter head twists around a horizontal axis, this twisting causes the golf ball to skip over the putting green rather than roll smoothly over the green in a straight direction. Any such twisting is also likely to impart less energy, and thus speed, to the ball, causing it to stop short of its intended target. A number of designs have been devised in an attempt to mitigate these problems.

In one design, the moment of inertia (MOI) of the putter heads has been increased. When a golf club head twists due to an off-center hit, it twists about an axis that goes through the center of gravity (CG) of the golf club head. In general, a higher MOI decreases the amount that a golf club head will twist when the same amount of force is applied to it. Two MOIs are generally measured and varied, $MOI_{xx}$ and $MOI_{zz}$. $MOI_{xx}$ is the moment of inertia about the X axis. In other words, $MOI_{xx}$ is the moment of inertia about a horizontal axis that runs from the toe side of the golf club to the heel side of the golf club and runs through the CG of the golf club head. An increased $MOI_{xx}$ keeps the golf club head from tilting along this horizontal axis if, for example, the golf ball is struck with a top portion or a bottom portion of the golf club.

By contrast, $MOI_{zz}$ is the moment of inertia about the Z axis. In other words, $MOI_{zz}$ is the moment of inertia about a vertical axis that runs from the top of the golf club head to the bottom of the golf club head and runs through the CG of the golf club head. An increased $MOI_{zz}$ decreases the amount the putter head twists with respect to the center line (e.g., the path of the golf club swing) when the putter head strikes a golf ball at the heel or toe of the putter.

In one design the $MOI_{zz}$ is increased by locating the CG of the putter head at a position at or behind the geometric center of the putter head. When the putter head strikes a golf ball, the rotational component of force that causes the putter head to twist is generally proportional to the angle created between a line from the CG to the off-center point of impact and a line from the CG through the direction of the swing. As this angle increases, the rotational force on the putter head increases as well, and the putter head twists to a greater degree. This angle is decreased as the CG of the putter head is moved further from the striking surface of the putter.

One method of moving the CG of the putter head away from the front of the golf club is to simply increase the mass at the rear of the putter head. This can be done in a plurality of different ways. For example, in one embodiment, the rear of the putter head is made of a material with different weight or density properties than the front of the putter head. In another embodiment, the putter head is designed such that the rear of the putter head is wider than the front of the putter head.

In another design, the $MOI_{zz}$ can be increased by designing the putter head such that the majority of the mass is at the outer edges of the putter head.

Several existing putter designs use one or more of these methods in combination with each other. For example, large mallet-style putter heads exist that generally provide a high $MOI_{zz}$ or $MOI_{xx}$ in combination with a rear-biased CG. Other putter heads offer a putter head wherein the width of the front of the putter head is narrower than the width of the rear of the putter head. However, none of the existing putter heads provide the features or advantages of the putter head disclosed herein.

A First Putter Head Embodiment

FIG. 1 illustrates a top plan view of a frusto-pyramidal embodiment of a putter head (100) according to the present invention. The putter head (100) comprises a heel side (118), a toe side (119), a rear portion (110), and a front portion (115) including a front face (112). The rear portion (110) and the front portion (115) are generally indicated by the horizontal dashed line (117) which is included for illustration but generally has no real-world counterpart. The putter head (100) further comprises a center section located between the vertical dashed lines (122, 125) (similarly provided for illustration but with no real world counter-part) comprising a front center portion (E) and a rear center portion (B). On either side of the center section the putter head (100) comprises first and second outer sections with first and second front outer portions (D, F) and first and second rear outer portions (A, C). The front center portion (E) includes a hosel (120) for attaching the putter head (100) to a golf club shaft (not shown). In other embodiments, the hosel may be located at a different portion of the putter head (100), for example in one of the first or second outer sections.

The putter head (100) further includes a CG (130). The CG (130) is generally centrally located side-to-side, as can be seen in FIG. 1. The X axis (X) extends along the width of putter head (100) and passes through the CG (130). As illustrated in FIG. 1, the CG (130) and the X axis (X) are located slightly to the rear of the horizontal dashed line (117) separating the front portion (115) from the rear portion (110). Generally, the distance (135) of the CG (130) from the front face (112) of the putter head (100) is no less than 30 mm and in some cases can be as high as 55 mm.

In certain embodiments, the putter head (100) generally has a mass between about 300 to about 500 grams. In these embodiments, the combined mass of the first outer front portion (D) and the first outer rear portion (A) is greater than 15% of the total mass of the putter head (100). Similarly, the combined mass of the second outer front portion (F) and the second outer rear portion (C) is greater than 15% of the total mass of the putter head. The mass of the first outer section can be the same as the second outer sections, or mass of the first outer section can be different from the second outer section.

In other embodiments of the putter head (100), the mass of the first outer rear portion (A) or the second outer rear portion (C) is greater than 11% of the total mass of the putter head. The first outer rear portion (A) may have the same mass as the second outer rear portion (C), or the mass of the first and second outer rear portions may be slightly different from each other.

One method of increasing the mass in the outer rear portions (A, C) is to make the front width (140) of the putter head (100) substantially smaller than the rear width (145) of the putter head. In the present disclosure, the ratio of the front width (140) to the rear width (145) is no greater than 0.55:1.

By increasing the amount of mass located in the outer sections of the putter head (100) and moving the CG (130) away from the front face (112) of the putter head, the $MOI_{zz}$ is substantially increased. Mass arrangements according to this disclosure have provided putter heads with an $MOI_{zz}$ greater than 400 kg-mm$^2$ and, in some embodiments, up to 1400 kg-mm$^2$.

Figure 2:
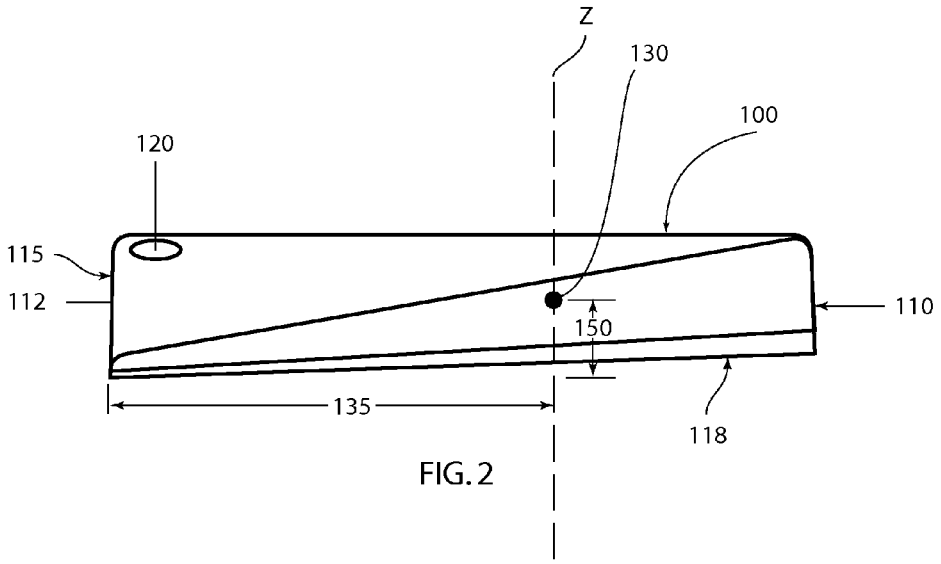
FIG. 2 illustrates a side elevation view from the heel side of the putter type golf club head of FIG. 1.

FIG. 2 illustrates a side elevation view of the putter head (100) of FIG. 1 as viewed from the heel side (118) of the putter head. The CG (130) is located a distance (150) from the bottom of the putter head (100). A Z axis (Z) extends from the top of the putter head (100), through the center of gravity (CG) and to the bottom of the putter head. In certain embodiments, the distance (150) of the CG (130) from the bottom of the putter head is less than or equal to about 13 mm, and is generally not more than about 10 mm. By limiting the distance (150) of the CG (130) from the bottom of the putter head (100) and moving the CG away from the front face (112) of the putter head, the $MOI_{xx}$ is substantially increased. In these embodiments, the $MOI_{xx}$ is greater than 200 kg-mm$^2$, and in certain embodiments the $MOI_{xx}$ is increased up to about 500 kg-mm$^2$.

Figure 3:
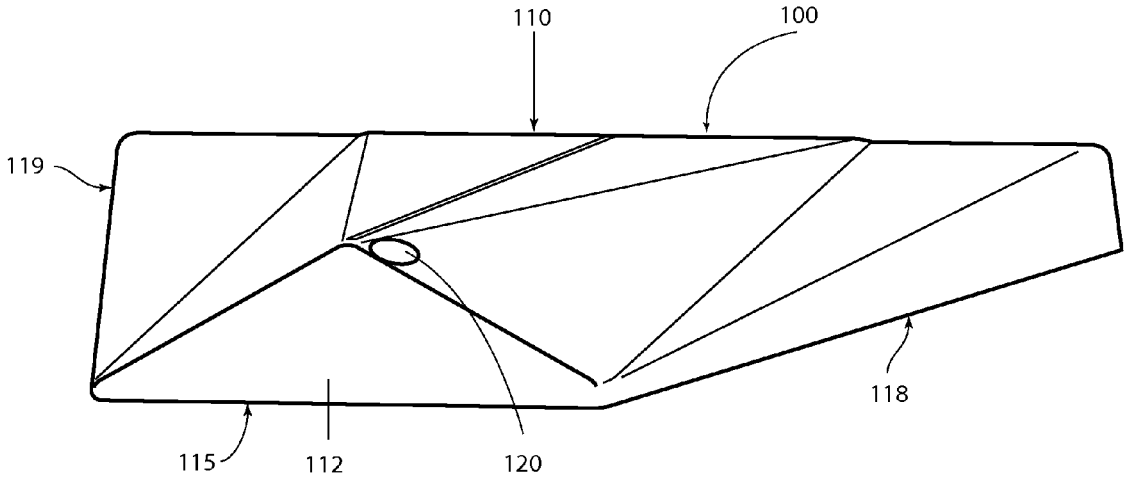
FIG. 3 illustrates a perspective view of the putter type golf club head of FIG. 1.

FIG. 3 illustrates a perspective view of the putter head (100) of FIG. 1 and shows the general shape of the front face (112) of the putter head.

In one example of the putter head (100), the total mass of the putter head is 348.2 grams. The mass of the first and second outer front portions (D, F) are 10.07 grams each. The mass of the front center portion (E) is 113.2 grams. In this example, the mass of the first outer rear portion (A) is 63.8 grams, the mass of the rear center portion (B) is 77.6 grams, and the mass of the second outer rear portion (C) is 73.4 grams. The combined mass of the first outer section is 10.07+63.8=73.87 grams which accounts for about 21% of the total mass of the putter head (100). The combined mass of the second outer section is 10.07+73.4=83.47 grams which accounts for about 24% of the total mass of the putter head (100). In this example, the mass of only the first rear outer portion (A) is 63.8 grams, which accounts for roughly 18% of the total mass of the putter head (100), and the mass of the second rear outer portion (C) is 73.4 grams which accounts for about 21% of the total mass of the putter head. The distance (135) of the CG (130) from the front face (112) of the putter head (100) is about 78.0 mm. In order to increase the mass of the first and second rear outer portions (A, C), the front width (140) is about 87.19 mm, and the rear width (145) is about 177.43 mm, thus making the ratio of the front width to the rear width about 0.49:1. This example is further constructed such that the distance (150) of the CG (130) from the bottom of the putter head (100) is about 13.2 mm. This design provides a $MOI_{zz}$ of about 1490.0 kg-mm$^2$ and a $MOI_{xx}$ of about 737.4 kg-mm$^2$.

In an alternative example of the first embodiment of the putter head (100), the total mass of the putter head is 348.4 grams. The mass of the first and second outer front portions (D, F) are 10.0 grams each. The mass of the front center portion (E) is 80.7 grams. The mass of the first outer rear portion (A) is 86.2 grams, the mass of the rear center portion (B) is 78.6 grams, and the mass of the second outer rear portion (C) is 83.5 grams. In this alternative example, the combined mass of the first outer section is 10.0+86.2=96.2 grams which accounts for about 28% of the total mass of the putter head (100). The combined mass of the second outer section is 10.0+83.5=93.5 grams which accounts for about 27% of the total mass of the putter head (100). Additionally, the mass of only the first rear outer portion (A) is 86.2 grams, which accounts for roughly 25% of the total mass of the putter head (100), and the mass of the second rear outer portion (C) is 83.5 grams which accounts for about 24% of the total mass of the putter head. The distance (135) of the CG (130) from the front face (112) of the putter head (100) is about 47.7 mm. In order to increase the mass of the first and second rear outer portions (A, C), the front width (140) is about 47.56 mm, and the rear width (145) is about 97.28 mm, thus making the ratio of the front width to the rear width about 0.49:1. This alternative example is further constructed such that the distance (150) of the CG (130) from the bottom of the putter head (100) is about 12.1 mm. This design provides a $MOI_{zz}$ of about 431.1 kg-mm$^2$ and a $MOI_{xx}$ of about 188.2 kg-mm$^2$.

A Second Putter Head Embodiment

Figure 4:
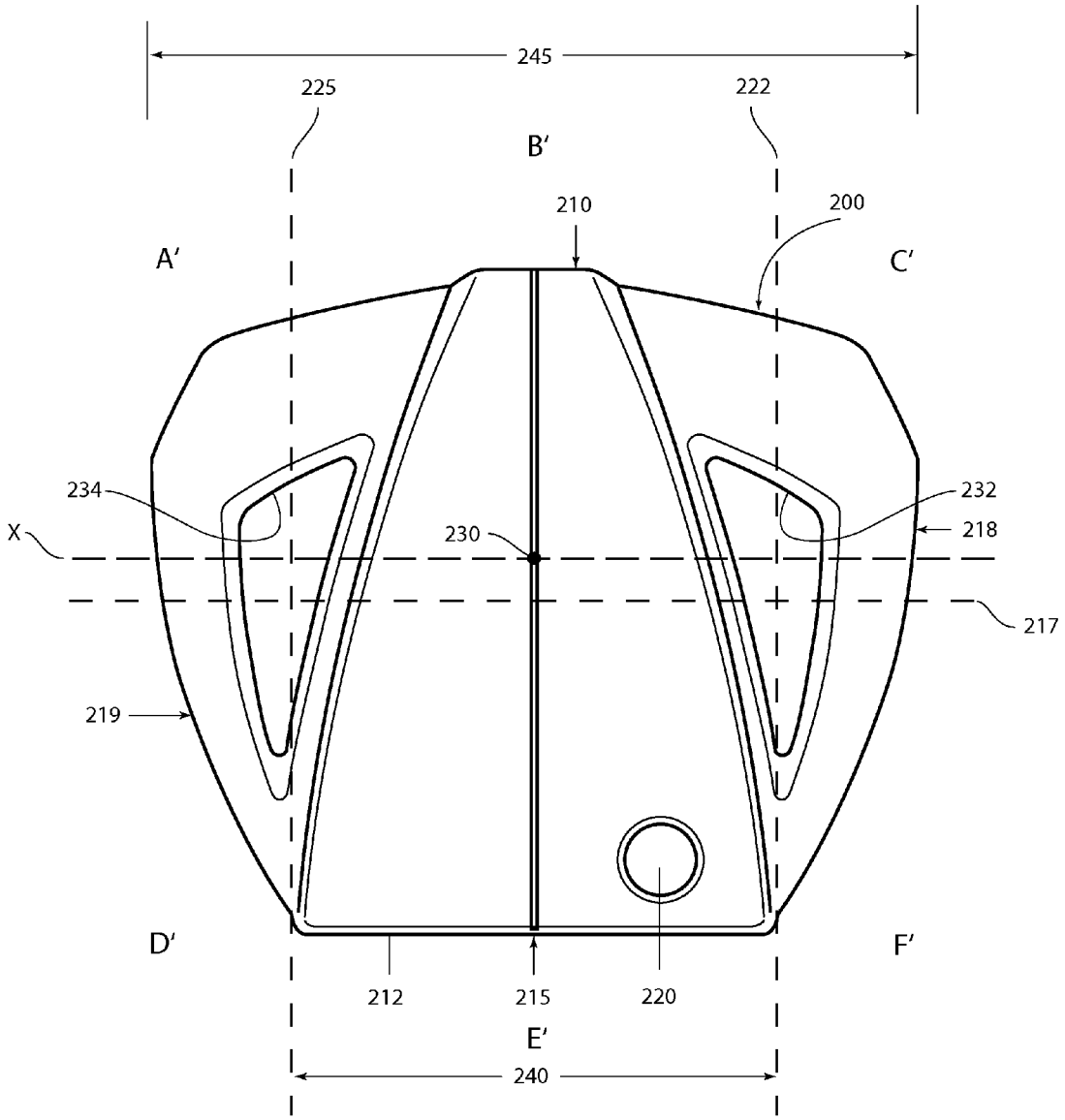
FIG. 4 illustrates a top plan view of a second embodiment of a putter type golf club according to the present invention.
Figure 5:
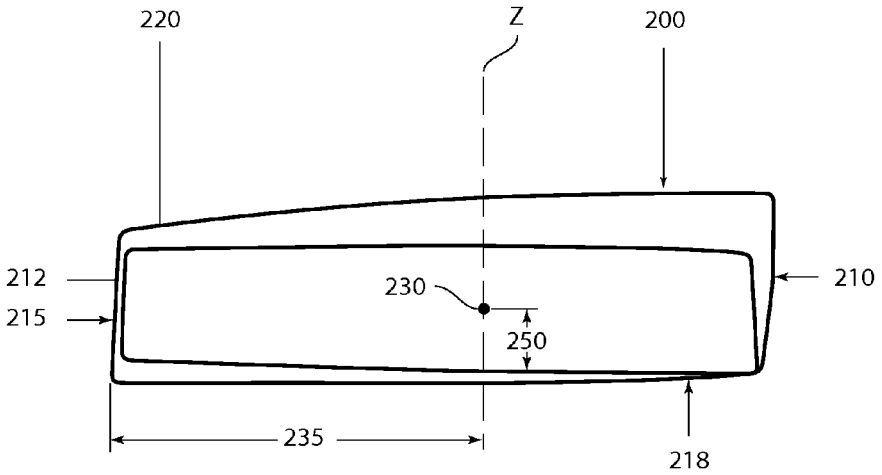
FIG. 5 illustrates a side elevation view from the heel side of the putter type golf club head of FIG. 4.
Figure 6:
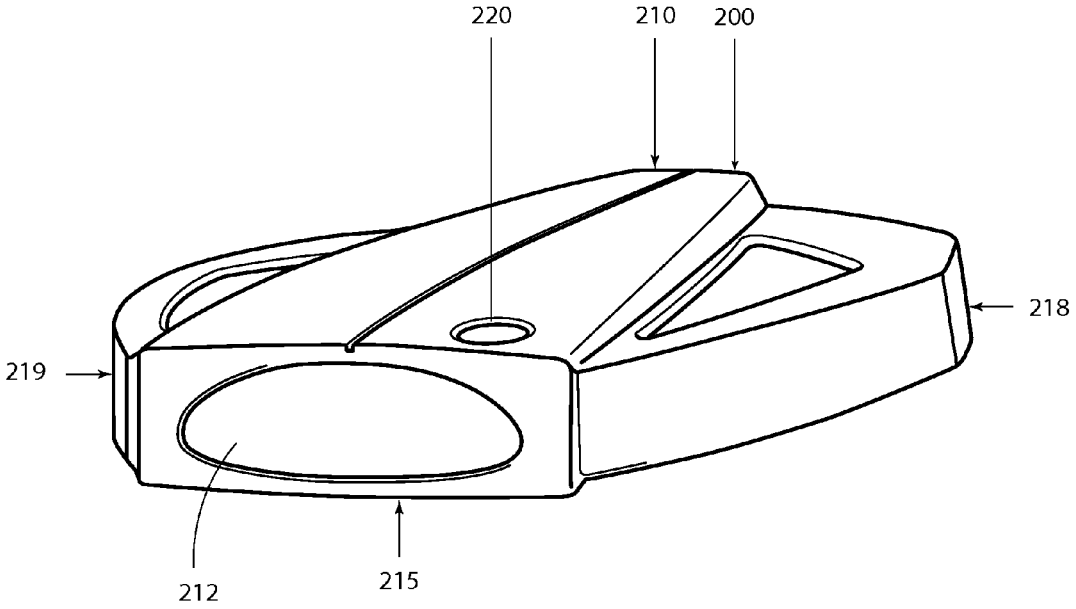
FIG. 6 illustrates a perspective view of the putter type golf club head of FIG. 4.

FIGS. 4, 5, and 6 illustrate an alternative embodiment of a putter head (200) according to the invention. Elements of this embodiment that correspond to elements of the first embodiment are identified by corresponding reference numerals, but preceded by the numeral "2" rather than the numeral "1". Generally, this embodiment of the putter head (200) comprises a heel side (218), a toe side (219), a rear portion (210), and a front portion (215) including a front face (212). The rear portion (210) and the front portion (215) are generally indicated by the horizontal dashed line (217) which is included for illustration but generally has no real-world counterpart. The putter head (200) further comprises a center section located between the vertical dashed lines (222, 125) (similarly provided for illustration but with no real world counterpart) comprising a front center portion (E') and a rear center portion (B'). On either side of the center section the putter head (200) comprises first and second outer sections with first and second front outer portions (D', F') and first and second rear outer portions (A', C'). The front center portion (E') includes a hosel (220) for attaching the putter head (200) to a golf club shaft (not shown). In other embodiments, the hosel may be located at a different portion of the putter head (200), for example in one of the first or second outer sections. The putter head further includes an X axis (X) passing through a center of gravity (230). In this embodiment, the putter head (200) further includes a heel-side cutout (232) and a toe-side cutout (234). Additionally, the front and rear center portions (B', E') are slightly thicker than the first and second front outer portions (D', F') and first and second rear outer portions (A', C').

In one example of the second embodiment of the putter head (200), the total mass of the putter head is 343.8 grams. The mass of the first and second outer front portions (D', F') is 58.8 grams each. The mass of the front center portion (E') is 33.5 grams. In this example, the mass of the first and second outer rear portions (A', C') is 83.6 grams each, and the mass of the rear center section (B') is 26.4 grams. The combined mass of the first and second outer sections is 58.8+83.6=142.4 grams each which accounts for about 41% of the total mass of the putter head (200). The mass of only the first or second rear outer portion (A' or C') is 83.6 grams, which accounts for roughly 24% of the total mass of the putter head (200). In order to increase the mass of the first and second rear outer portions (A', C'), the front width (240) is about 59.65 mm, and the rear width (245) is about 101.12 mm, thus making the ratio of the front width to the rear width about 0.59:1. This example is further constructed such that the distance (250) of the CG (230) from the bottom of the putter head (200) is about 11.8 mm. This design provides a $MOI_{zz}$ of about 660.5 kg-mm$^2$ and a $MOI_{xx}$ of about 163.6 kg-mm$^2$.

Benefits of the Disclosed Invention

The $MOI_{zz}$ is increased by moving the CG away from the front face of the putter head by increasing the mass at the rear portions of the putter head (as described, for example, in the first exemplary putter head embodiments). Additionally, as described in the second exemplary putter head embodiment, the $MOI_{zz}$ is increased by designing the putter head such that a large percentage of the mass in located in first or second outer sections on either side of the center section of the putter head. Generally, an ideal putter head will combine both of these methods, as described in the second exemplary putter head embodiment, though either of these methods can be used individually.

The amount that the putter head twists around a vertical Z axis during an off-center hit towards the heel or toe of the putter head decreases by increasing the $MOI_{zz}$, and the amount that the ball deviates from an intended course will be similarly decreased. Even if the amount that the putter head twists is reduced by only a couple of degrees, this can significantly decrease the amount of deviation from the player's intended ball placement for the shot.

Similarly, by moving the CG away from the front face of the putter head and reducing the distance of the CG from the bottom of the putter head, the $MOI_{xx}$ of the putter head is increased. An increased $MOI_{xx}$ results in the putter head twisting less around a horizontal X axis during an off-center hit towards the top or bottom of the putter head. Thus, the putter head transfers more energy directly into the ball in a lateral direction, which results in the ball rolling sooner. Thus, the ball rolls smoothly and in a straight line rather than skipping over the ground which can cause unpredictable deviations from the intended course of the shot.

Certain embodiments of the putter head use one or more of the principles described above, though each of the designs may be used independently. In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

We claim:

1. A putter head comprising:

a top and a bottom;

a front face having a front width and a rear portion having a rear width;

at least one center section with a first center section extending behind the front face toward the rear-portion;

at least one heel section that extends laterally outwardly from a first side of at least one center section and comprising at least about 11% of a total mass of the putter head;

at least one toe section that extends laterally outward from a second side of at least one center section and comprising at least about 11% of the total mass of the putter head;

a center of gravity located in one of the center sections and approximately centered between the toe and the heel sections;

wherein a medial axis parallel to the front face and spaced approximately equidistant between the front face and the rear face defines a boundary between the front and rear heel sections, the front and rear toe sections and the at least one center section, respectively;

a Z axis located at the center of gravity, a moment of inertia about the Z axis ranging between about 400 kg-mm$^2$ and 1500 kg-mm$^2$; and an X axis located at the center of gravity, a moment of inertia about the X axis ranging between about 160 kg-mm$^2$ and 740 kg-mm$^2$;

wherein the shortest distance between the center of gravity and the bottom is at least 10 mm.

2. The putter head of claim 1, wherein the putter head has a total mass of between about 300 to about 500 grams.

3. A putter comprising:

a shaft;

a putter head attached to the shaft, the putter head comprising:

a top portion, a bottom portion, a front face with a front width, a rear portion with a rear width, and a total mass;

at least one center section extending behind the front face to the rear face;

front and rear first outer sections that extend outwardly from a first side of at least one center section and together comprise no less than about 15% of the total mass of the putter head; and front and rear second outer sections that extend outwardly from a second side of the center sections and together comprise no less than about 15% of the total mass of the putter head, wherein a medial axis parallel to the front face and spaced approximately equidistant between the front face and the rear portion defines a boundary between the front and rear first outer sections and the front and rear second outer sections, respectively, the head having a center of gravity, an X axis passing through the center of gravity with a moment of inertia about the X axis ranging between about 160 kg-mm$^2$ and about 740 kg-mm$^2$, and a Z axis passing through the center of gravity with a moment of inertia about the Z axis ranging between about 400 kg-mm$^2$ and about 1500 kg-mm$^2$.

4. The putter of claim 3, wherein the putter head has a total mass of between about 300 to about 500 grams.

5. A golf club head for a putter comprising:

a front face with a front width, a rear portion having a rear width, a top portion, a bottom portion, a heel side, a toe side, a total mass, a center of gravity, an X axis passing through the center of gravity with a moment of inertia about the X axis ranging between about 160 kg-mm$^2$ and about 740 kg-mm$^2$, and a Z axis passing through the center of gravity with a moment of inertia about the Z axis ranging between about 400 kg-mm$^2$ and about 1500 kg-mm$^2$;

a body extending behind the front face toward the rear portion;

wherein a medial axis is defined to be parallel to the front face and spaced approximately equidistant between the front face and the rear portion;

a first outer section that extends laterally outwardly from the heel side of the body, and a second outer section that extends laterally outwardly from the toe side of the body, the first and second outer sections each extending rearwardly of the medial axis;

a heel side cutout located toward the heel side of the club head, and a toe side cutout located toward the toe side of the club head;

wherein the shortest distance between the center of gravity and the front face ranges between about 30 mm and about 55 mm; and wherein the vertical distance from the bottom portion to the center of gravity is less than about 15 mm, and wherein the total mass is between about 300 to about 500 grams.

6. The golf club head of claim 5, wherein each of the first and second outer sections comprises no less than about 15% of the total mass of the putter head.

7. The golf club head of claim 5, wherein the first outer section comprises between about 15% and about 25% of the total mass of the golf club head.

8. The golf club head of claim 5, wherein the first outer section comprises about 24% of the total mass of the golf club head.

9. The golf club head of claim 5, wherein:

the first outer section comprises a first front outer section and a first rear outer section that each extend laterally outwardly from the heel side of the body; and the second outer section comprises a second front outer section and a second rear outer section that each extend laterally outwardly from the toe side of the body;

with each of the first and second front outer sections comprising no less than about 15% of the total mass of the golf club head, the first and second front outer sections each extending forwardly of the medial axis.

10. The golf club head of claim 9, wherein the front and rear first outer sections together comprise about 41% of the total mass of the golf club head.

11. The golf club head of claim 10, wherein the front and rear second outer sections together comprise about 41% of the total mass of the golf club head.

* * * * *

UNITED STATES PATENT AND TRADEMARK OFFICE

CERTIFICATE OF CORRECTION

PATENT NO. : 9,050,510 B2
APPLICATION NO. : 14/076796
DATED : June 9, 2015
INVENTOR(S) : Marni D. Ines and Bret H. Wahl It is certified that error appears in the above-identified patent and that said Letters Patent is hereby corrected as shown below:

In the Claims:

Column 7, lines 44-45, "front face and the rear face defines" should read --front face and an end of the rear portion defines--.

Column 8, lines 8-9, "front face and the rear portion defines" should read --front face and an end of the rear portion defines--.

Column 8, line 35, "front face and the rear portion" should read --front face and an end of the rear portion--.

Signed and Sealed this
Twenty-second Day of September, 2015

Michelle K. Lee

Michelle K. Lee
*Director of the United States Patent and Trademark Office*